United States Patent [19]

Tani et al.

[11] Patent Number: 4,804,585

[45] Date of Patent: Feb. 14, 1989

[54] CONCRETE REINFORCING STEEL FIBERS AND A METHOD OF MANUFACTURING THE SAME

[75] Inventors: Yoshio Tani; Susumu Takata; Kazuo Kamei, all of Kobe, Japan

[73] Assignee: Kabushiki Kaisha Kobe Seiko Sho, Kobe, Japan

[21] Appl. No.: 911,877

[22] Filed: Sep. 26, 1986

[51] Int. Cl.[4] ..... E04C 5/03; C04B 14/48

[52] U.S. Cl. ..... 428/574; 428/600; 106/99

[58] Field of Search ..... 428/573, 574, 577, 582, 428/600, 606; 106/99

[56] References Cited

U.S. PATENT DOCUMENTS

| | | | |
|---|---|---|---|
| 1,635,222 | 7/1927 | Plaut | 428/574 |
| 2,780,860 | 2/1957 | Brickman | 428/573 |
| 3,214,877 | 11/1965 | Akin | 428/574 |
| 3,592,727 | 7/1971 | Weaver et al. | 428/600 |
| 3,728,211 | 4/1973 | Ball et al. | 106/99 |
| 3,900,667 | 8/1975 | Moens | 428/603 |
| 3,953,953 | 5/1976 | Marsden | 428/603 |
| 4,559,276 | 12/1985 | Tezuka et al. | 428/600 |
| 4,560,622 | 12/1985 | Tezuka et al. | 428/600 |
| 4,585,487 | 4/1986 | Destree et al. | 428/606 |

FOREIGN PATENT DOCUMENTS

| | | | |
|---|---|---|---|
| 150113 | 8/1984 | Japan | 428/603 |

*Primary Examiner*—John J. Zimmerman

*Attorney, Agent, or Firm*—Oblon, Fisher, Spivak, McClelland & Maier

[57] ABSTRACT

A concrete reinforcing steel fiber has an alternate arrangement of basic portions corresponding to the body of the steel fiber material, and section-shaped portions formed by pressing the steel fiber material between a grooved forming roller and a toothed forming roller. Each section-shaped portion has a flat upper surface, lateral projections and a round bottom. The pressure bearing area b of the section-shaped portion, namely, the sum of the cross-sectional area of the lateral projections and the area of the end surface of the basic portion contiguous with the section-shaped portion, is in the range of 0.2A to 0.5A (A=cross-sectional area of the basic portion). The total pressure bearing area B of the steel fiber is in the range of 3A and 8A, and also in the range of 0.02T and 0.08T (T=tensile strength of the steel fiber).

7 Claims, 21 Drawing Sheets

FIGURE 3

| SPECIMENS NO. | d (mm) | L (mm) | p (mm) | DEPTH OF DEPRESSION | b ($mm^2$) | B ($mm^2$) | ENERGY ABSORBED BEFORE FRACTURE(%) | REMARK |
|---|---|---|---|---|---|---|---|---|
| A | 0.6 | 50 | 4 | ORDINARY | 0.26A | 3.25A | 100 | |
| B | 0.6 | 50 | 4 | LARGISH | 0.40A | 5.0A | 105 | |
| C | 0.6 | 50 | 4 | LARGE | 0.5A | 6.25A | 88 | SOME S.F. WERE BROKEN |
| D | 0.6 | 50 | 4 | SMALLISH | 0.24A | 3.0A | 96 | |
| E | 0.6 | 50 | 4 | SMALL | 0.14A | 1.75A | 78 | S. F. SLIPPED OFF |
| F | 0.6 | 20 | 4 | ORDINARY | 0.26A | 1.3A | 55 | S. F. SLIPPED OFF |
| G | 0.6 | 100 | 4 | ORDINARY | 0.26A | 6.5A | | MIXING WAS IMPOSSIBLE |
| H | 0.6 | 70 | 4 | ORDINARY | 0.26A | 4.55A | | MIXING WAS DIFFICULT |
| I | 0.6 | 30 | 4 | ORDINARY | 0.26A | 1.95A | 72 | |
| J | 0.6 | 50 | 23 | ORDINARY | 0.26A | 5.65A | 82 | S. F. WERE BROKEN |
| K | 0.6 | 50 | 8 | ORDINARY | 0.26A | 1.63A | 84 | S. F. SLIPPED OFF |
| L | 0.6 | 40 | 4 | LARGISH | 0.40A | 4.0A | 97 | |
| M | 0.6 | 50 | 2 | LARGISH | 0.40A | 10.0A | 72 | S. F. WERE BROKEN |
| N | 0.6 | 50 | 1.5 | LARGISH | 0.40A | 133A | 63 | S. F. WERE BROKEN |

FIGURE 6

| SPECIMENS NO. | d (mm) | L (mm) | p (mm) | DEPTH OF DEPRESSION | b ($mm^2$) | B ($mm^2$) | T ($\frac{Kg}{mm^2}$) | ENERGY ABSORBED BEFORE FRACTURE (%) | REMARK |
|---|---|---|---|---|---|---|---|---|---|
| A−0 | | | | ORDINARY | 0.26A | 3.25A | 115 | 100 | |
| B−0 | 0.6 | 50 | 4 | LARGISH | 0.40A | 5.0A | 115 | 105 | |
| C−0 | | | | LARGE | 0.50A | 6.25A | 115 | 94 | |
| A−1 | | | | ORDINARY | 0.26A | 3.25A | 70 | 81 | |
| B−1 | 0.6 | 50 | 4 | LARGISH | 0.40A | 5.0A | 70 | 93 | |
| C−1 | | | | LARGE | 0.50A | 6.25A | 70 | 78 | |
| A−2 | | | | ORDINARY | 0.26A | 3.25A | 40 | 62 | |
| B−2 | 0.6 | 50 | 4 | LARGISH | 0.40A | 5.0A | 40 | 54 | S. F. WERE BROKEN |
| C−2 | | | | LARGE | 0.50A | 6.25A | 40 | 48 | S. F. WERE BROKEN |

CONCRETE REINFORCING STEEL FIBERS AND A METHOD OF MANUFACTURING THE SAME

BACKGROUND OF THE INVENTION

1. Field of the Invention

The present invention relates to concrete reinforcing steel fibers to be mixed in concrete for reinforcing concrete and to a method of manufacturing such concrete reinforcing steel fibers.

2. Description of the Prior Art

In recent years, various composite materials having new properties which have never been found in individual materials have been developed. In the civil engineering and architectural industries, it has been desired to improve the properties of concrete which is inexpensive and has both many advantages and many disadvantages such as brittleness and liability to fissure. Recently, steel fiber reinforced concrete (hereinafter referred to simply as "reinforced concrete") having high tensile strength and very high toughness has been developed and become fully applied to practical uses. Generally, such a reinforced concrete contains 1 to 2% by volume (80 to 160 kg/m$^3$) steel fibers having a diameter in the range of 0.4 to 0.6 mm and a length in the ranage of 20 to 60 mm. Various researches and development activities have been conducted in the fields of steel fiber manufacturing techniques, steel fiber application techniques and the utilization of steel fibers and the reinforced concrete.

Incidentally, in order to prepare the reinforced concrete containing steel fibers in the above-mentioned volume ratio, 80 to 160 kg of steel fibers per one cubic meter of concrete are necessary, and hence in placing the reinforced concrete in the practical construction work, a large quantity of steel fibers must be supplied.

The following steel fiber manufacturing methods have been proposed for the mass production of steel fibers.

(1) A thin plate shearing method in which a coil of cold-rolled thin steel plate having a thickness in the range of 0.2 to 0.7 mm is cut with a rotary blade.

(2) A thin plate cutting method in which hundreds of thin steel sheets having a thickness in the range of 0.2 to 0.7 mm are placed one over another in a pile, and then the pile of thin steel sheets is cut with a cutter on a planer.

(3) A wire cutting method in which drawn steel wires having an appropriate diameter are cut in a predetermined length.

(4) A cutting method in which steel slabs or steel ingots are cut on a planer.

(5) A centrifugal method in which a water-cooled rotary disk provided with threads in the circmference thereof is placed in contact with the ssurface of molten steel to draw out the molten steel for instantaneous solidification in steel fibers and to scatter the steel fibers by centrifugal force.

The steel fibers manufactured by those steel fiber manufacturing methods, respectively, are different from each other in characteristics, and provides the reinforced concrete with different strength characteristics, respectively.

The adhesion of the steel fibers to concrete is considered to be a direct and dominant factor affecting the strength of the reinforced concrete. Although the tensile strength of the steel fibers can be easily measured, it is difficult to measure the strength of adhesion of the steel fibers to concrete in the reinforced concrete.

The function of steel fibers in an ordinary reinforced concrete not prestressed is to adhere to concrete, to take charge of a portion of the load acting on the reinforced concrete, to reinforce the concrete so that cracks will not develop, and to reinforce the concrete so that the concrete will not break.

Basically, steel fibers are used for the above-mentioned function, however, since steel fibers are more capable of being integrated with concrete than steel bars, steel fibers are expected to absorb as much energy as possible when the reinforced concrete is broken and to provide the reinforced concrete structure with high toughness.

To enable steel fibers exhibit the excellent performance and to produce steel fibers of high performance at a reduced cost, the steel fibers must be well balanced in characteristics, namely, the tensile strength must be equal to the adhesion to concrete. Such a condition is explained theoretically by $$\pi \cdot d \cdot l/4 \cdot \tau = \pi d^2/4 \cdot \sigma_f, \text{ hence, } \sigma_f = \tau d$$

where d = the diameter of the steel fiber, l = the length of the steel fiber, $\tau$ = the strength of adhesion of the steel fiber to concrete, and $\sigma_f$ = the tensile strength of the steel fiber.

If the strength of adhesion of the steel fiber to concrete is excessively large, $$\pi \cdot d \cdot l/4 \cdot \tau > \pi d^2/4 \cdot \sigma_f$$

Therefore, when the reinforced concrete is loaded, the steel fibers will be broken before being extracted from the reinforced concrete.

If the strength of adhesion of the steel fiber to concrete is excessively small, $$\pi \cdot d \cdot l/4 \cdot \tau < \pi d^2/4 \cdot \sigma_f$$

Therefore, the steel fibers will be extracted from the reinforced concrete before the steel fibers are broken, and hence the steel fibers are unable to fully exhibit their tensile strength.

In order to enhance the adhesion of the steel fiber to concrete, various designs on the shape of the steel fiber have been proposed. Typical steel fibers having a special shape are:

(a) a steel fiber having a straight axis and varying in cross section along the axis, (b) a steel fiber having a wavy axis, and (c) a steel fiber having ends formed in a special shape.

These shapes are experiential shapes and not theoretical shapes. The steel fiber of (b) is unsatisfactory in respect of effecitve length and is uneconomical, while the steel fiber of (c) has difficulty in manufacture. The steel fiber (a) is economical, easy to manufacture and stable and uniform in quality. In manufacturing the steel fiber of (a), it is essential to design the cross section of the section-shaped portions so that the steel fiber is balanced between the tensile strength and the strength of adhesion to concrete. Although the higher the surface irregularlity, the greater the strength of adhesion to concrete, the tensile strength diminishes with increase in the variation of the cross section along the axis. Therefore, the degree of the surface irregularity of the steel fiber must be chosen so that the steel fiber is balanced between the tensile strength and the strength of adhesion to concrete. However, as regards the morphology of the section-shaped portion of the steel fiber, nothing is elucidated as to the preferable degree of expansion of the section shaped portion and measures to enhance the toughness of the reinforced concrete incorporating the steel fibers. Accordingly, steel fibers having a theoretical shape appropriate to the enhancement of the toughness of the reinforced concrete are not produced at the present.

SUMMARY OF THE INVENTION

The present invention has been made on the basis of a knowledge that the steel fibers produced through a wire cutting process can be section-shaped in various surface morphologies by rolling the steel fibers with forming rollers and the essential characteristics, such as capability to provide the reinforced concrete with a sufficient toughness (capacity of energy absorption before fracture), tensile strength and bending strength, can be optionally controlled by varying the surface morphology of the steel fibers.

Accordingly, it is an object of the present invention to provide a high-performance steel fiber capable of enhancing the toughness of the reinforced concrete.

It is another object of the present invention to provide a high-performance, inexpensive, section-shaped steel fiber well balanced between the tensile strength and the strength of adhesion to concrete.

It is a further object of the present invention to provide a high-performance, section-shaped steel fiber enhanced in the strength of adhesion to concrete without entailing significant reduction of the tensile strength.

It is still a further object of the present invention to provide a method of manufacturing such high-performance section-shaped steel fibers at a low cost.

According to the present invention, a rolled or drawn steel wire is subjected to a section-shaping process employing a pair of forming rollers. One of the forming rollers is provided in the circumference thereof with an annular groove capable of partly receiving the steel wire, while the other forming roller is provided in the circumference thereof with teeth for section-shaping the steel wire.

The above and other objects, features and advantages of the present invention will become more apparent from the following description of the preferred embodiment taken in conjunction with the accompanying drawings.

BRIEF DESCRIPTION OF THE DRAWINGS

FIG. 3 is a table showing the characteristics of section-shaped steel fibers including those of the present invention and varying in the dimensional factors;

FIG. 6 is a table showing the tensile strength of the section-shaped steel fibers, the total pressure bearing area and the toughness;

DESCRIPTION OF THE PREFERRED EMBODIMENTS

Figure 1:
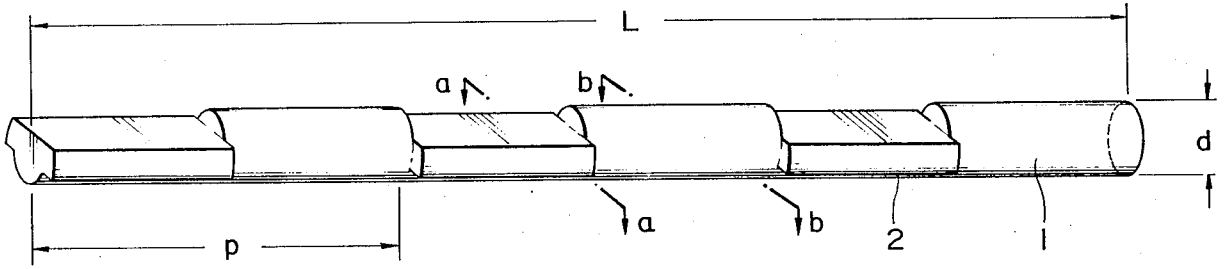
FIG. 1 is a perspective view of a section-shaped steel fiber, in a first embodiment, according to the present invention.

FIG. 1 is a perspective view of a section-shaped steel fiber made through a wire cutting process. In FIG. 1, indicated at 1 are basic portions and at 2 are section-shaped portions. The basic portions 1 and the section-shaped portions 2 are arranged alternately. The basis portion 1 has a diameter d; the steel fiber has a length L; and the section-shaped portions 2 are formed at a pitch P.

Figure 2B:
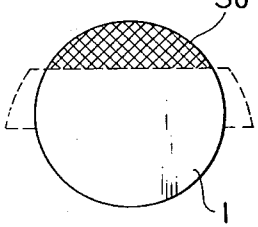
FIGS. 2*a* and 2*b* are sectional views taken on line a—a and on line b—b in FIG. 1.
Figure 2A:
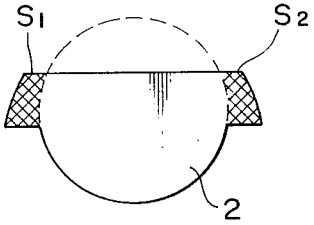

FIGS. 2*a* and 2*b* are sectional views taken on line a—a and on line b—b in FIG. 1, respectively.

The pressure bearing area b of one section-shaped portion 2 is expressed by $$b=S1+S2+S0$$

where S1 and S2 are pressure bearing areas shown in FIG. 2*a*, and S0 is a pressure bearing area shown in FIG. 2*b*. Therefore, the total pressure bearing area B of the steel fiber is expressed by $$B=b\times L/P$$

Several kinds of steel fibers varying from each other in the depth of depression of the section-shaped portion 2 were produced. Square mortar bars each containing 1% by volume each kind of steel fibers were made. The square mortar bars were subjected to a bending test. The area bounded by the stress-strain curve of each square mortar bar and the x-axis was measured to provide a value representing the quantity of absorbed energy. The measured results are tabulated in FIG. 3.

Figure 4:
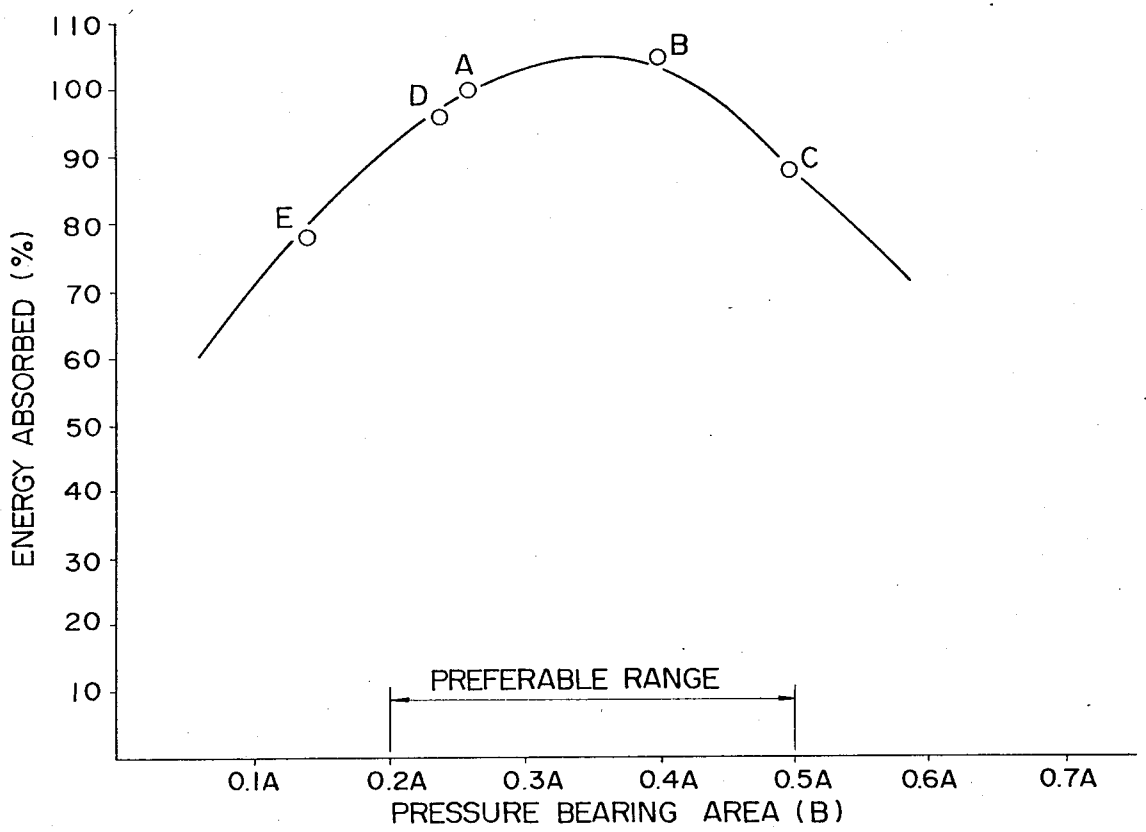
FIG. 4 is a graph showing the variation of the quantity of energy absorbed by the section-shaped steel fibers with the pressure bearing area.
Figure 5:
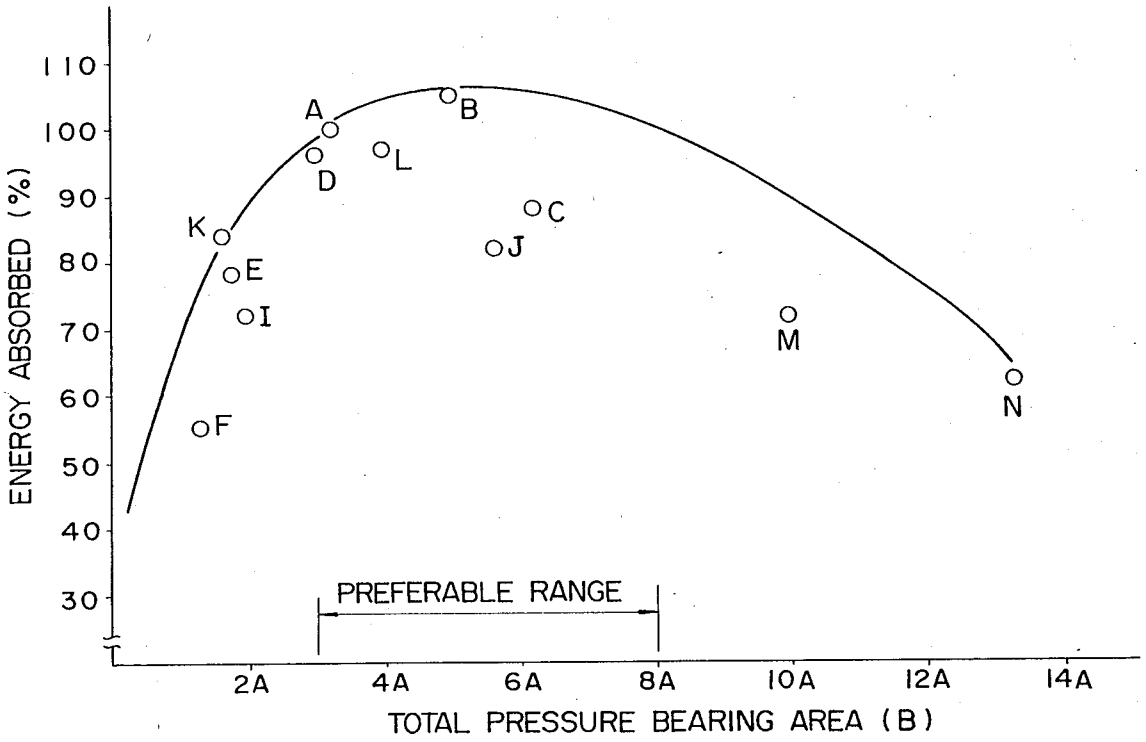
FIG. 5 is a graph showing the variation of the quantity of energy absorbed by the section-shaped steel fibers with the total pressure bearing area.

FIG. 4 is a graph showing the dependence of the quantity of absorbed energy on the pressure bearing area b and FIG. 5 is a graph showing the dependence of the quantity of absorbed energy on the total pressure baring area B.

As is evident from the results of the bending test, the preferable range of the pessure bearing area b is $$0.2A\leqq b\leqq 0.5A$$

where A is the sectional area of the basic portion 1.

As regards toughness, steel fibers having a smaller depth of depression and steel fibers having a long pitch and a longer length are superior to steel fibers having a greater depth of depression, provided that the total pressure bearing area B is fixed.

Accordingly, most preferably, the average quantity of absorbed energy is 78 when the aspect ratio (L/d) is in the range of 60 to 100, and the average quantity of energy absorbed is 64 when the aspect ratio is outside the foregoing range.

The average quantity of energy absorbed is 86 when the pitch P is in the range of 4d to 10d, and is 75 when the pitch P is outside the foregoing range.

FIG. 6 shows the dependence of the toughness on the total pressure bearing area B for the tensile strength T of the steel fiber.

Figure 7:
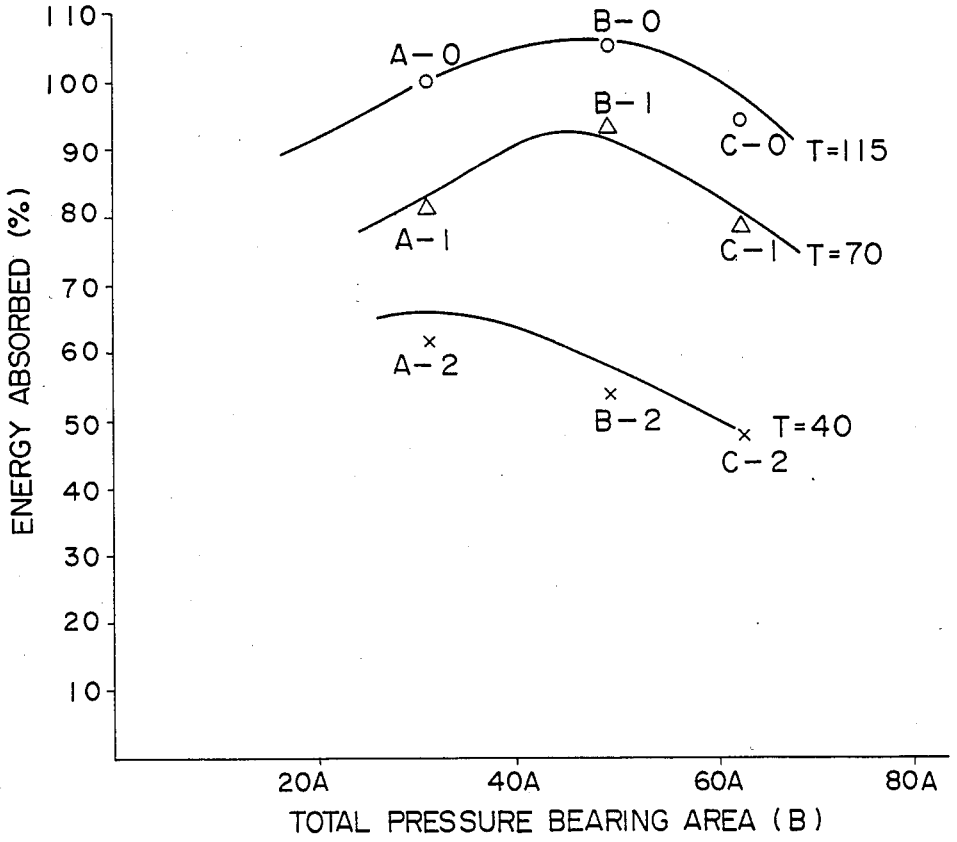
FIG. 7 is a graph showing the variation of the quantity of energy absorbed with the total pressure bearing area for tensile strength.
Figure 8:
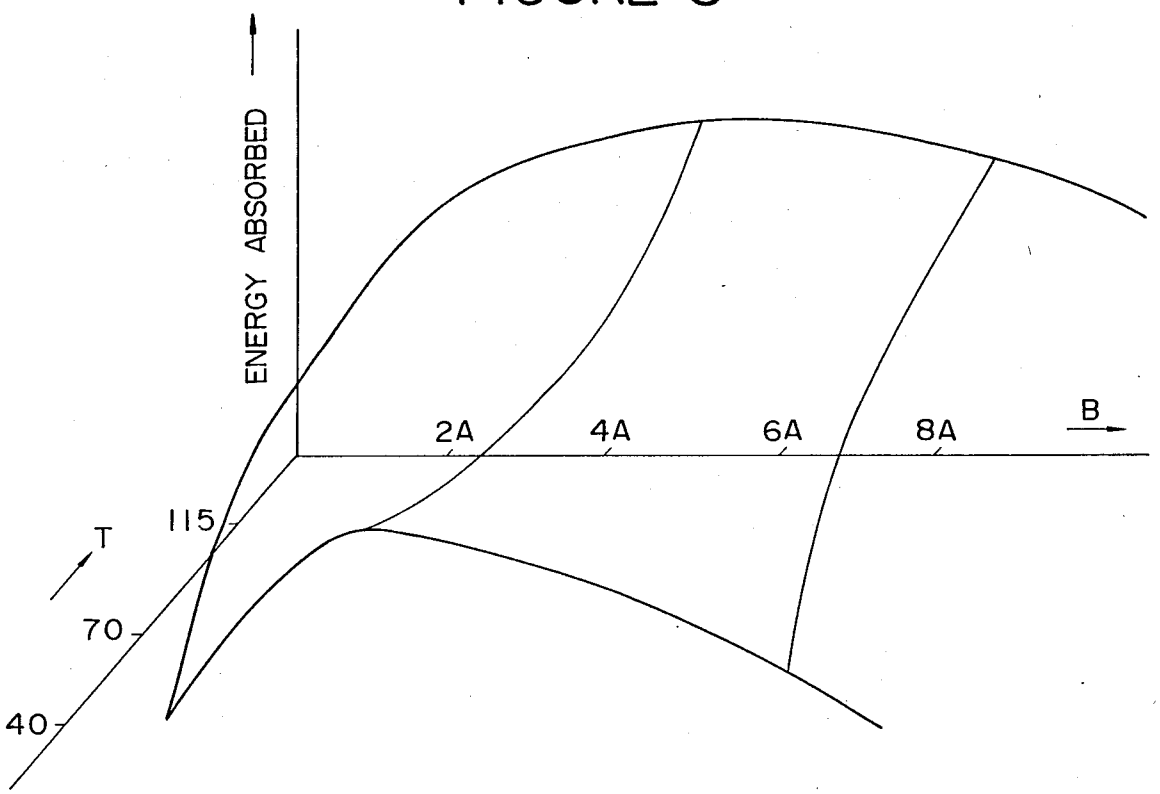
FIG. 8 is a stereographic representation of the relation between the total pressure bearing area, the tensile strength and the toughness.

FIG. 7 is a graph showing the dependence of the toughness on the total pressure bearing area B for tensile strength T and FIG. 8 is a stereographic representation of the total pressure bearing area B-the tensile strength T-the toughness relation.

Figure 9:
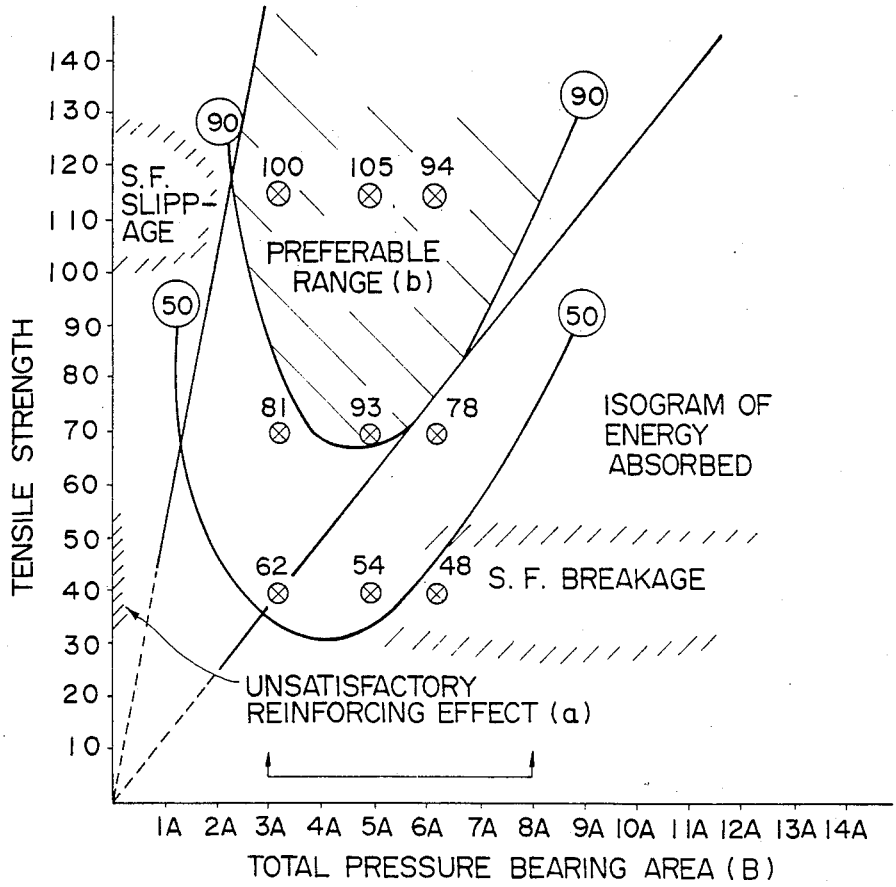
FIG. 9 is a graph showing the relation between the total pressure bearing area and the tensile strength.

FIG. 9 is a graph showing the dependence of the total pressure bearing area B on the tensile strength $\sigma_f$ of the steel fibers.

In FIG. 9, the characteristics of the conventional commercial steel fibers of the straight type (not section-shaped) are in a region (a), while those of the steel fibers of the present invention are in a desirable region (b). As compared with the conventional steel fibers, the steel fibers of the present invention have higher tensile strength and higher strength of adhesion to concrete.

Figure 10A:
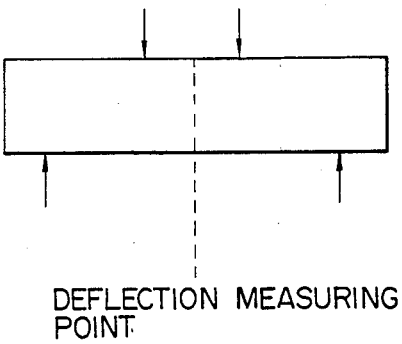
FIG. 10*a* is a schematic illustration of assistance in explaining the manner of the bending test.
Figure 10B:
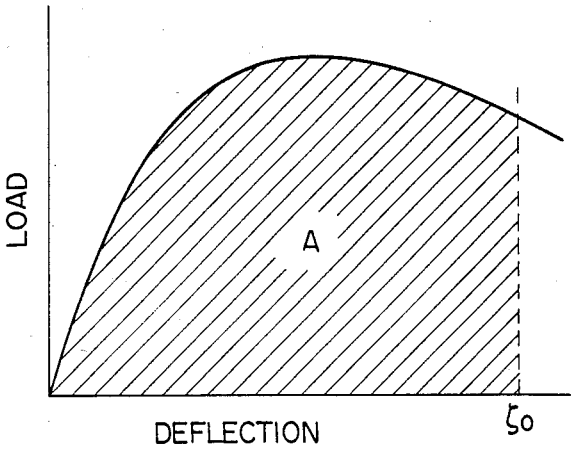
FIG. 10*b* is a graph showing a typical stress-strain curve obtained through the bending test.

In the bending test for determining the quantity of absorbed energy, the specimen was supported at the opposite ends and was loaded at two points dividing the length between the supported points into three portions as illustrated in FIG. 10*a*. Then, the shaded area A kg.mm shown in FIG. 10*b* was measured to represent the quantity of absorbed energy. The deflection was a fixed value of 1/150 of the length between the supporting points.

The section-shaped portions of the steel fibers in this embodiment are depressed for section-shaping on the same side, however, each section-shaped portion may be depressed on the opposite sides or the depressed sides may be inverted alternately for the successive section-shaped portions. Furthermore, the shape of the cross section of the steel fiber material need not necessarily be circular, but may be any suitable shape as a square or hexagonal shape.

Thus, the present invention determines an optimum range of sectional area between the basic portion and the section-shaped portion of steel fibers manufactured by section-shaping the steel fibers produced through the wire cutting process. When mixed in concrete, the section-shaped steel fibers of the present invention adhere firmly to concrete to fully take charge of a portion of the load applied to the reinforced concrete, restrict the development of fissures in the reinforced concrete and prevent the fracture of the reinforced concrete. Thus the section-shaped steel fibers of the present invention fully exhibit the function thereof to meet the requirements of concrete reinforcing steel fibers.

A second embodiment of the present invention will be described hereinafter.

Figure 11:
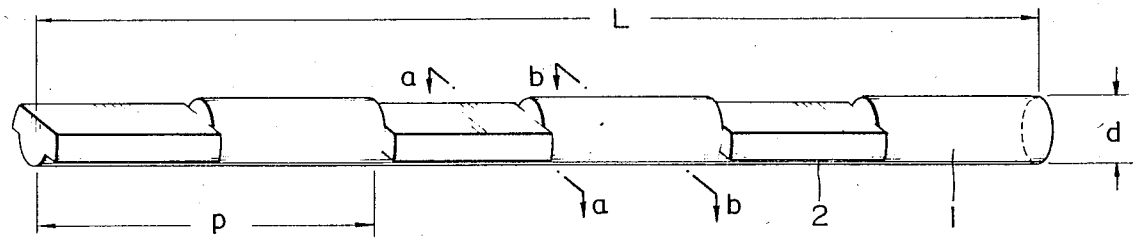
FIG. 11 is a perspective view of a section-shaped steel fiber, in a second embodiment, according to the present invention.

As illustrated in FIG. 11, a steel fiber in a second embodiment according to the present invention has basic portions 1 and section-shaped portions 2. The basic portions 1 and the section-shaped portions 2 are arranged alternately. The steel fiber material has a diameter d and a length L. The section-shaped portions 2 are formed at a pitch P.

Figure 12B:
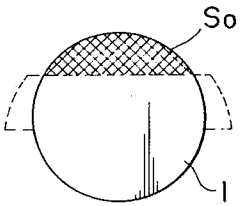
FIGS. 12*a* and 12*b* are sectional views taken on line a—a and on line b—b in FIG. 11.
Figure 12A:
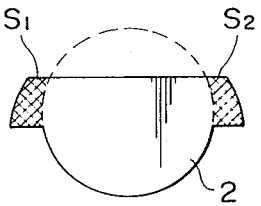

As illustrated in FIG. 12, the resistance of the steel fiber against extraction of the same from concrete, namely, the strength of adhesion to concrete, is dependent on the pressure bearing areas S0, S1 and S2, and the number of the section-shaped portions in the steel fiber. The strength of adhesion to concrete is represented by a pressure bearing area coefficient B.A. defined by $$B.A. = \frac{S0 + S1 + S2}{P \times \pi d} = \frac{2 \times (S1 + S2)}{P \times \pi d}$$

$$S0 = S1 + S2 = d_1 \sim d_2 \times \pi d^2/4$$

$$= \frac{2 \times (\alpha_1 \sim \alpha_2) \times \pi d^2/4}{(4d \sim 12d) \times \pi d}$$

$$= \left(\frac{1}{24} \sim \frac{3}{24}\right) \times (\alpha_1 \sim \alpha_2)$$

Therefore, a suitable range of B.A is $\alpha_1/24$ to $3\alpha_2/24$ $$S0 = S1 + S2 = (\alpha \sim \alpha) \times \pi d/4$$

Optimum range of pressure bearing area ratio $\alpha$ is 10 to 20%.

Optimum range of the pitch P is 4d to 12d.

$$\alpha_1/24 = 0.1/24 = 0.0042,\ 3\alpha_2/24 = 3 \times 0.2/24 = 0.025$$

Figure 13:
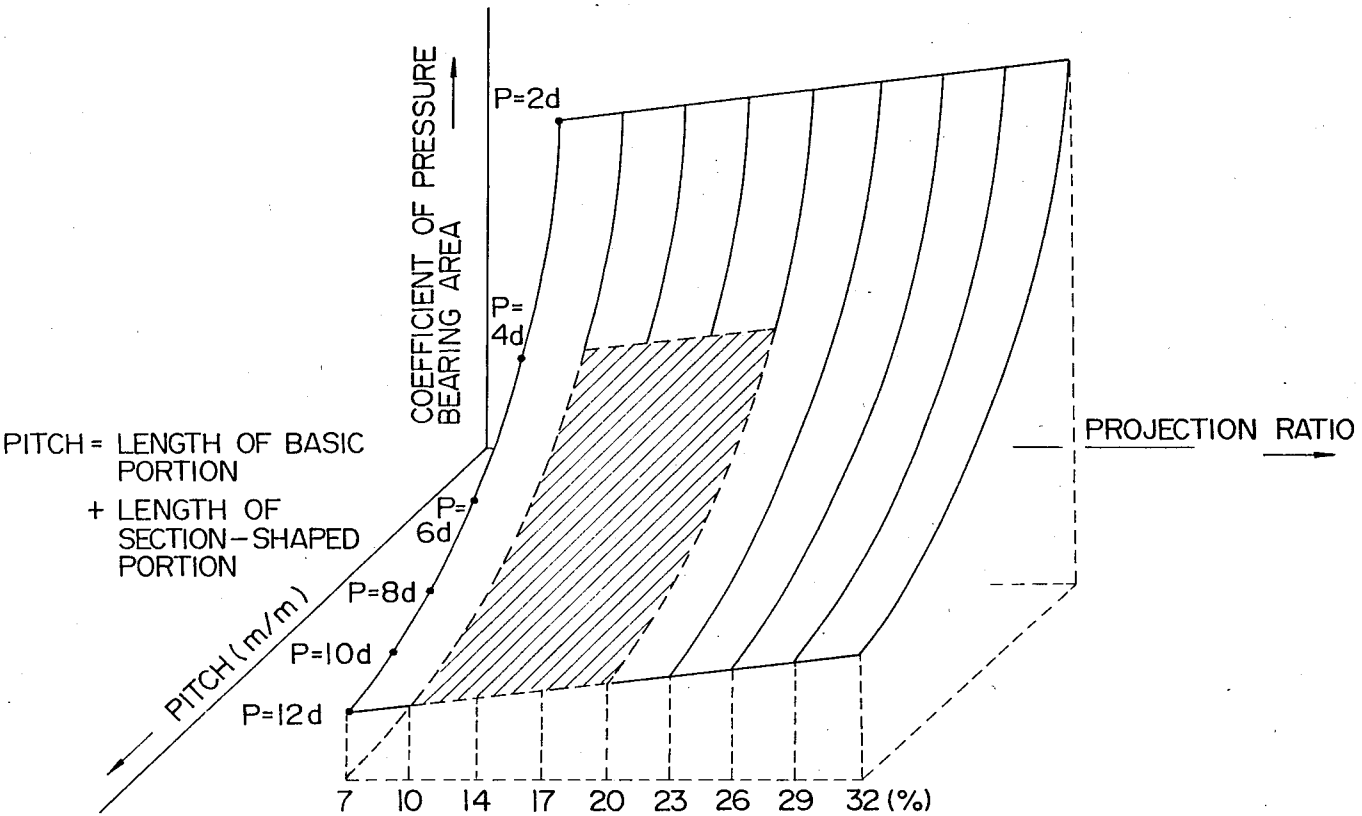
FIG. 13 is a stereographic representation of the relation between the projection ratio, the pitch and the pressure bearing area coefficient.
Figure 14A:
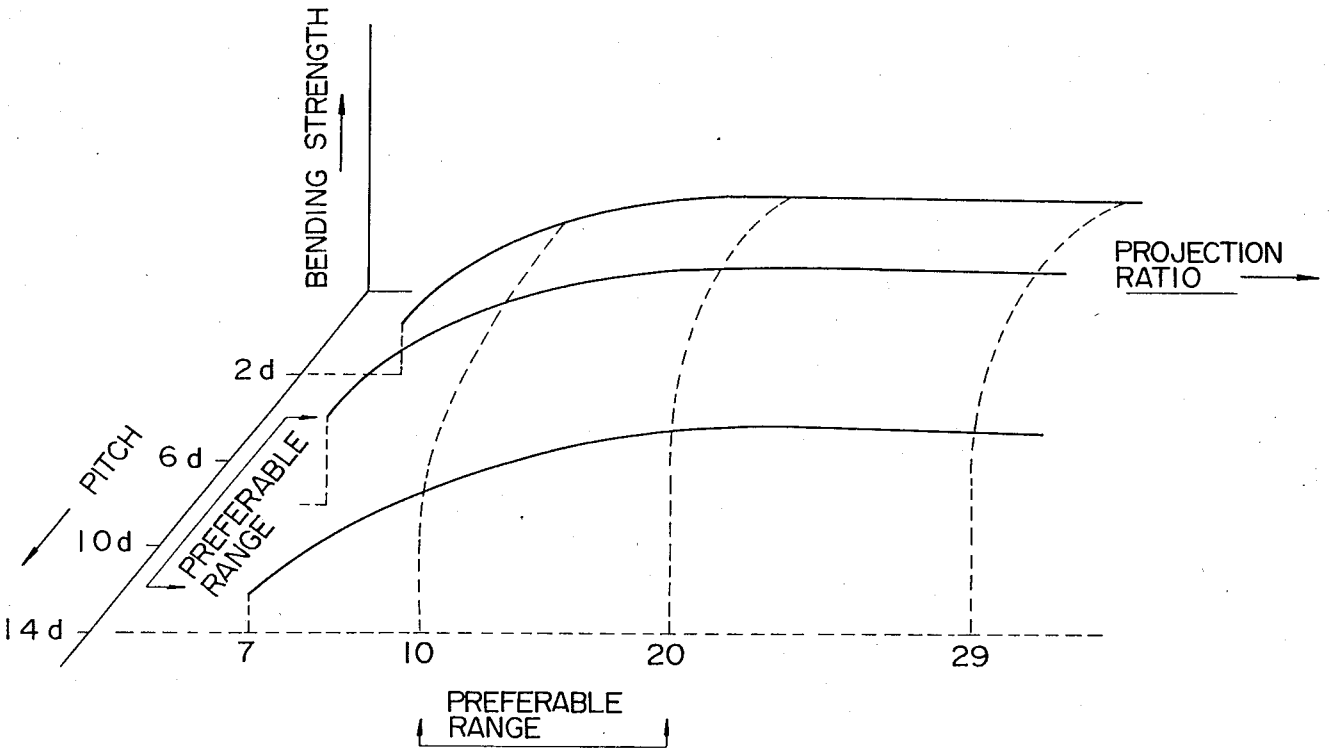
FIGS. 14*a* and 14*b* are stereographic representations showing the relation between the bending strength, the pitch and the projection ratio, and the relation between the bending toughness, the pitch and the projection ratio, respectively.
Figure 14B:
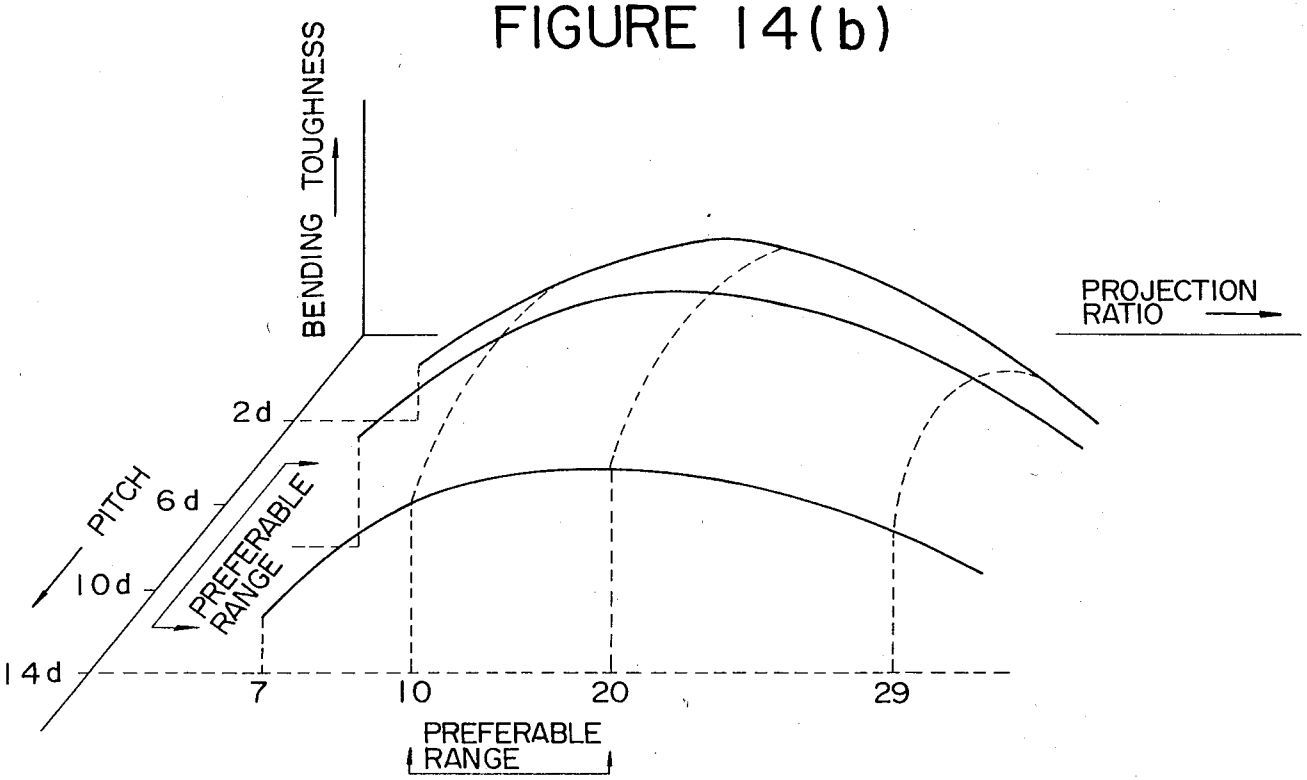

The characteristics of the section-shaped steel fibers according to the present fall in the shaded portion in the graph of FIG. 13.

Optimum steel fiber material for forming the section-shaped steel fiber of the present invention has a straight axis, a tensile strength in the range of 100 to 140 kg/mm$^2$, and a diameter in the range of 0.3 to 1.0 mm.

Thus, according to the second embodiment of the present invention, an optimum range of the pressure bearing area coefficient is determined so that the section-shaped steel fibers of the present invention are balanced between the tensile strength and the strength of adhesion to concrete. Accordingly, when mixed in concrete, the section-shaped steel fibers of the present invention adhere firmly to concrete to fully take charge of a portion of the load applied to the reinforced concrete and restrict the development of fissures in the reinforced concrete and prevent the fructure of the reinforced concrete. Thus the section-shaped steel fibers of the present invention fully exhibit the function thereof to meet the requirements of concrete reinforcing steel fibers. Furthermore, the section-shaped steel fibers of the present invention can be manufactured at a low cost.

A section-shaped steel fiber in a third embodiment will be described hereinafter.

Figure 15:
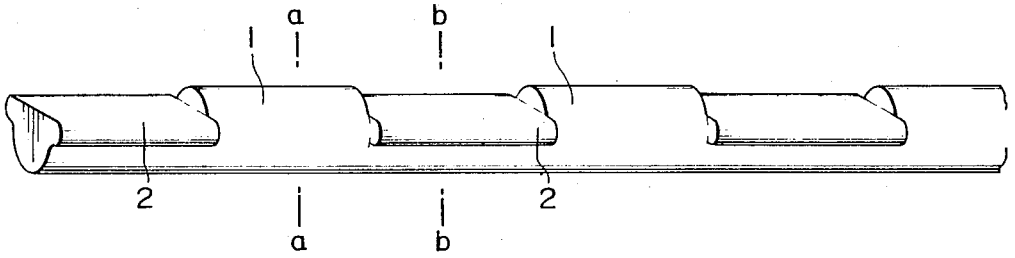
FIG. 15 is a perspective view of a section-shaped steel fiber, in a third embodiment, according to the present invention.

As illustrated in FIG. 15, basic portions 1 and section-shaped portions 2 are formed alternately along the axis of a section-shaped steel fiber. In this embodiment, the steel fiber material is a steel fiber having a circular cross section, a straight axis, a diameter in the range of 0.3 to 1.0 mm, a length in the range of 15 to 80 mm, and a tensile strength in the range of 100 to 140 kg/mm$^2$. The respective lengths of the basic portion 1 and the section-shaped portion 2 are on the order of twice to twelve times the diameter. However, the basic portion and the section-shaped portion need not necessarily be the same in length.

The section-shaped steel fiber in the third embodiment has section-shaped portions 2 depressed for section-shaping on the same side, however, each section-shaped portion 2 may be depressed on the opposite sides or the depressed sides may be inverted alternately for the successive section-shaped portions. Naturally, the shape of the cross section of the basic portion 1 need not necessarily be a circular shape, but may be any suitable shape such as a square or hexagonal shape.

Figure 16B:
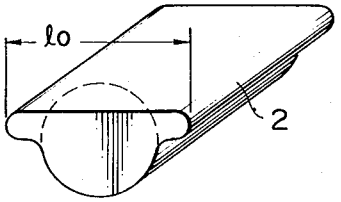
FIGS. 16*a* and 16*b* are perspective views of the basic portion and the section-shaped portion of the section-shaped steel fiber of FIG. 15, respectively.
Figure 16A:
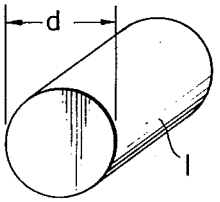

Referring to FIGS. 16*a* and 16*b*, a projection ratio is defined by $$\text{Projection ratio} = [(l_0 - d)/d] \times 100\ (\%)$$

where d is the diameter of the steel fiber material, namely, the diameter of the basic portion 1, and $l_0$ is the width of the depressed surface of the section-shaped portion 2.

Figure 17:
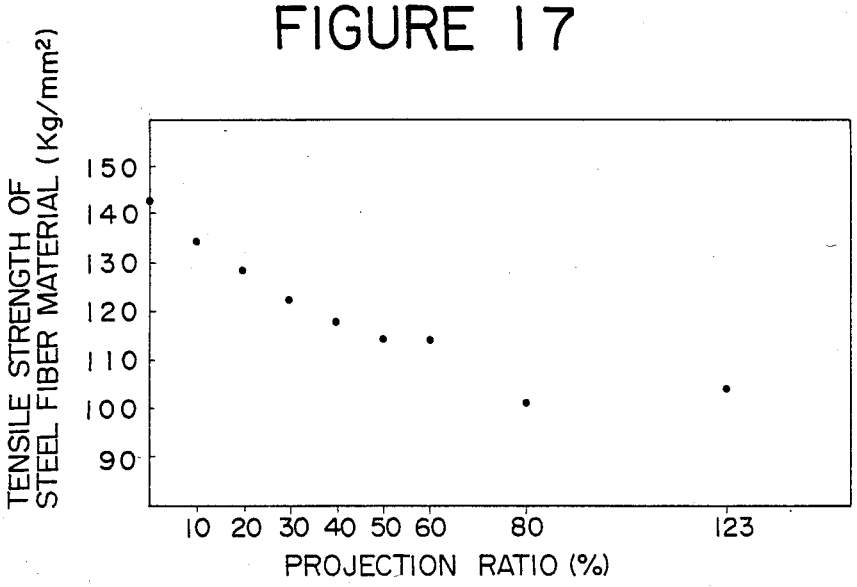
FIG. 17 is a graph showing the relation between the tensile strength of the steel fiber material and the projection ratio.

Speciments of section-shaped steel fibers varying from each other in the projection ratio were subjected to a tensile strength test. The results of the tensile strength test are shown in FIG. 17. As is evident from FIG. 17, the tensile strength diminishes with the increase of the projection ratio and diminishes sharply when the projection ratio increases over a value about 60%.

Figure 18:
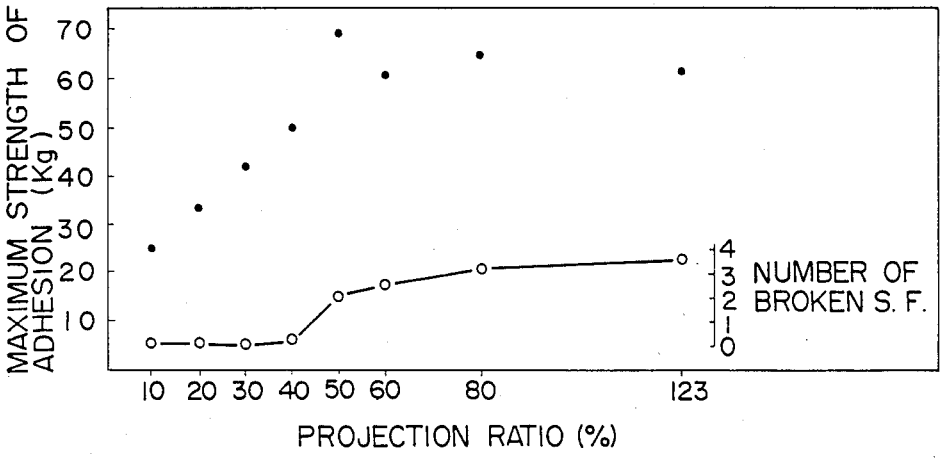
FIG. 18 is a graph showing the relation between the maximum strength of adhesion to concrete and the projection ratio of the section-shaped steel fiber of the third embodiment.

Reinforced concrete specimens reinforced with the section-shaped steel fibers of the present invention were subjected to a test for testing the strength of adhesion of the section-shaped steel fibers to concrete. The results of the test are shown in FIG. 18. As is evident from FIG. 18, the strength of adhesion to concrete increases with the increase of the projection ratio until the projection ratio increases to a value near 60% and, thereafter, remains substantially at a fixed value. When the projection ratio is greater than 40%, the number of broken section-shaped steel fibers increases sharply.

Figure 19:
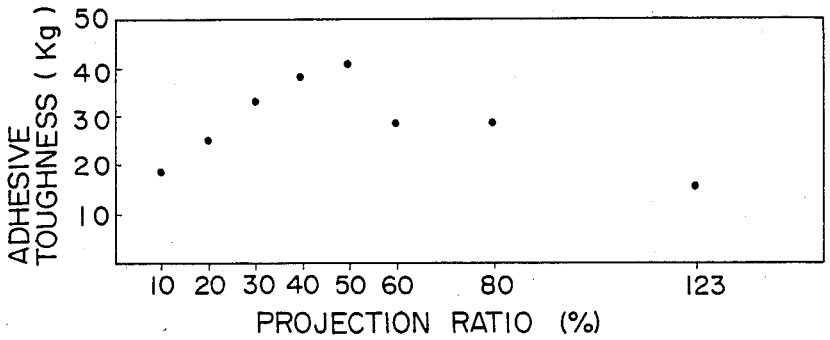
FIG. 19 is a graph showing the relation between the adhesive toughness and the projection ratio.

The adhesive toughness of the section-shaped steel fibers of the present invention was tested. The results of the adhesive toughness test are shown in FIG. 19. As is evident from FIG. 19, the plot of the adhesive toughness vs the projection ratio has a peak at a projection ratio about 50%. Thus, the adhesive toughness is reduced when the projection ratio is greater or smaller than 50%.

It can be readily inferred from the results of the foregoing tests that the section-shaped steel fibers are drawn out when the projection ratio is small, and the same are broken when the projection ratio is large.

Figure 20:
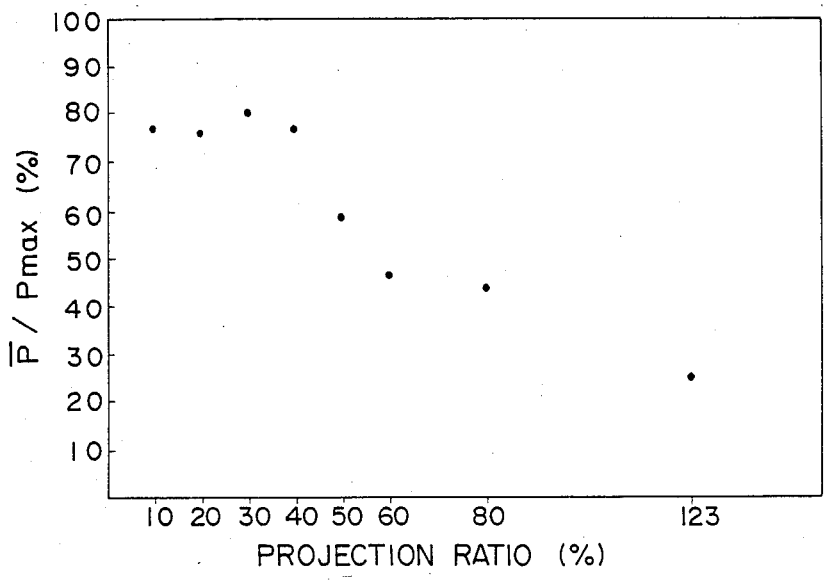
FIG. 20 is a graph showing the relation between the ratio of the adhesive toughness to the maximum strength of adhesion to concrete, and the projection ratio.

FIG. 20 is a graph showing the dependence of adhesive toughness P-to-maximum adhesive toughness $P_{max}$ on the projection ratio. As is evident from FIG. 20, since both the adhesive toughness P and the maximum adhesive toughness $P_{max}$ increases with the increase of the projection ratio until the projection ratio increases to 40%, the adhesive toughness P-to-maximum adhesive toughness $P_{max}$ remains at a fixed value slightly below 80%. When the projection ratio increases over 40%, the rate of increase of $P_{max}$ decreases and the adhesive toughness P decreases and the P-to-$P_{max}$ ratio decreases accordingly.

Figure 21:
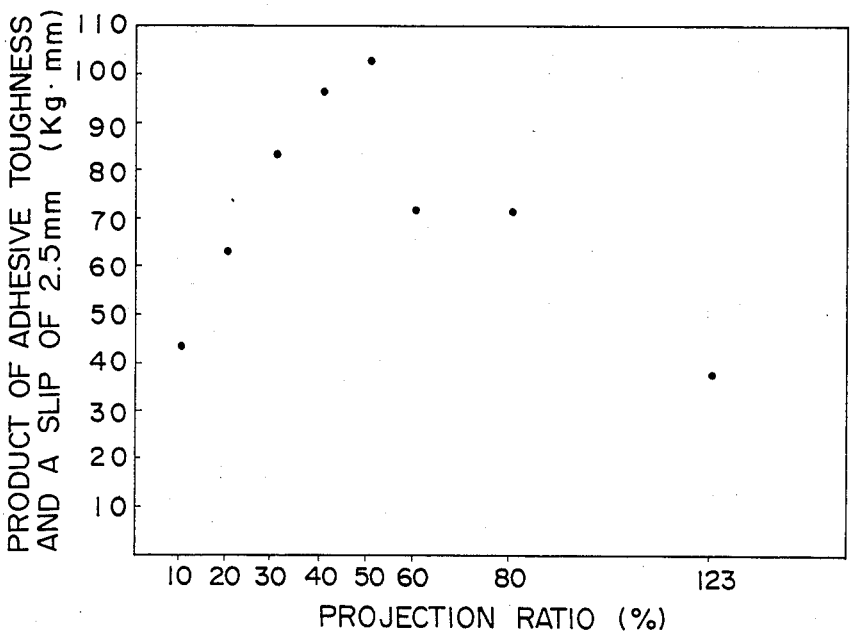
FIG. 21 is a graph showing the relation between the product of adhesive toughness and a slip of 2.5 mm, and the projection ratio.

FIG. 21 is a graph showing the variation of the product of adhesive toughness and a slip of 2.5 mm, namely, the quantity of work exerted by the section-shaped steel fiber while the same slips by a distance of 2.5 mm, with the projection ratio. Since the product of adhesive toughness and a slip distance is a physical quantity substantially the same as the adhesive toughness, the shape of the curve shown in FIG. 21 is similar to that shown in FIG. 19.

Figure 22:
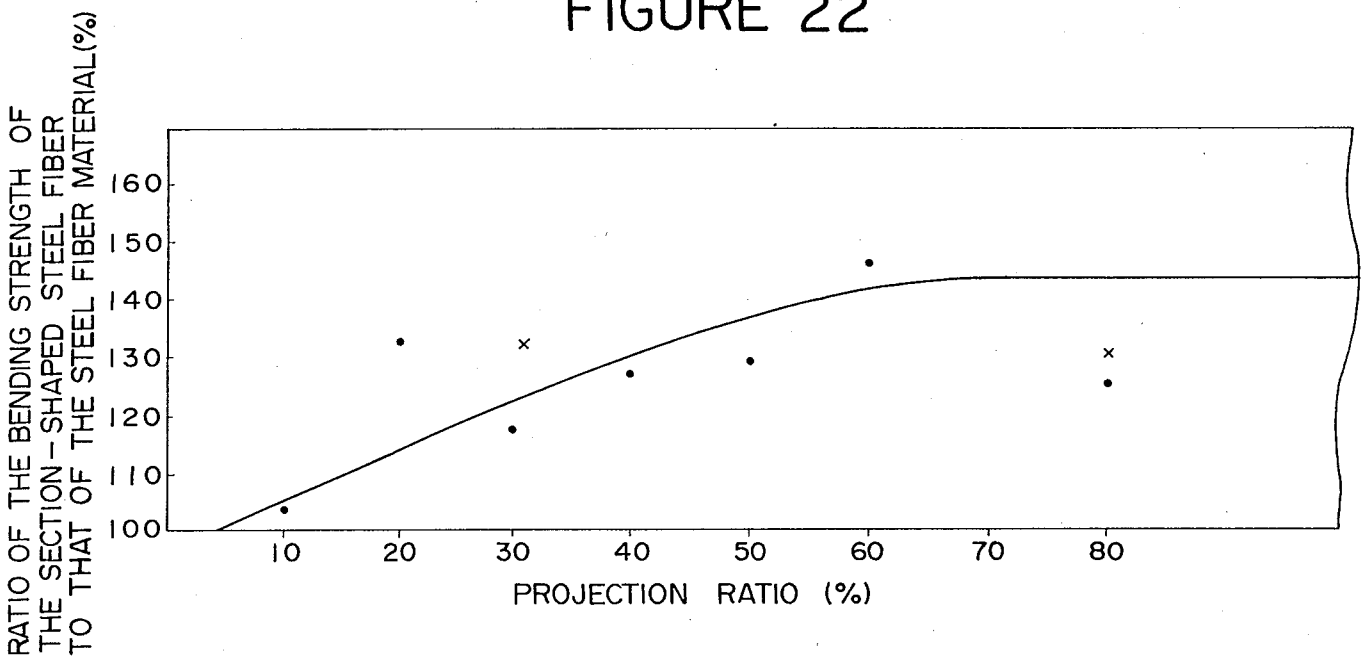
FIG. 22 is a graph showing the relation between the ratio of the bending strength of the section-shaped steel fiber to that of the steel fiber material, and the projection ratio.

Reinforced concrete bars reinforced with the section-shaped steel fibers in the third embodiment were subjected to a bending test. The results of the bending test are shown in FIG. 22. As is evident from FIG. 22, the bending strength of the reinforced concrete bars increases with the projection ratio until the projection ratio increases to a value near 60% and, thereafter, the bending strength remains substantially at a fixed value.

Figure 23:
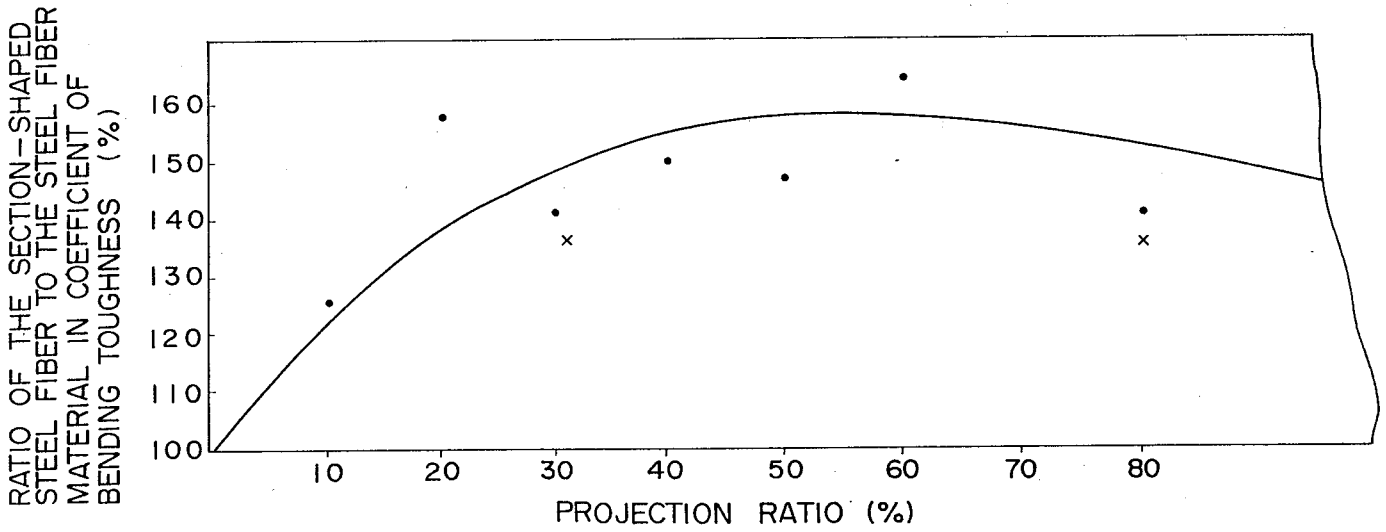
FIG. 23 is a graph showing the relation between the ratio of the bending toughness coefficient of the section-shaped steel fiber to that of the steel fiber material, and the projection ratio.

As shown in FIG. 23, the bending toughness coefficient of the reinforced concrete bars has a peak value at a projection ratio near 50%. The bendng toughness coefficient decreases when the projection ratio increases over and decreases below the projection ratio near 50%. The curve shown in FIG. 23 is similar to that of the variation of the adhesive toughness with the projection ratio shown in FIG. 19.

An optimum projection ratio is determined by taking the following matters into consideration in addition to the foregoing test results.

(a) From a consideration of the bending strength and bending toughness coefficient of the reinforced concrete, an optimum projection ratio is on the order of 50% (FIGS. 22 and 23), where the bending toughness coefficient reaches its peak value.

(b) The strength of the junction of the basic portion and the section-shaped portion decreases with the increase of the projection ratio, and hence the section-shaped steel fiber are bent disadvantageously in mixing concrete and the section-shaped steel fibers, when the projection ratio is excessively high entailing the reduction of strength of the reinforced concrete.

(c) The higher the degree of surface irregularity of the section=shaped steel fiber is, the more is the liability of the section-shaped steel fibers to entanglement and to forming fiber balls (lumps of steel fibers). The fiber balls deteriorates the strength of the reinforced concrete. Furthermore, since the high-degree surface irregularity of the section-shaped steel fibers requires a high pressure for forming the section-shaped portions, the load on the motors increases and the abrasion of the rollers increases increasing the manufacturing cost.

From the general evaluation of the matters (a), (b) and (c), an optimum projection ratio is in the range of 50%, where the performance of the reinforced concrete is the greatest, to 20%, where the performance of the reinforced concrete is practically acceptable.

Thus, according to the present invention, steel fibers produced through a wire cutting process are section-shaped so that the section-shaped steel fibers are well balanced between the tensile strength and the strength of adhesion to concrete, and an optimum shape of the section-shaped steel fibers is determined by a preferable range of the projection ratio. Accordingly, when mixed in concrete, the section-shaped steel fibers of the present invention adhere firmly to concrete to fully take charge of a portion of the load applied to the reinforced concrete, restrict the development of fissures in the reinforced concrete to the least extent and fully exhibit the reinforcing effect.

A method of manufacturing the foregoing section-shaped steel fibers will be described hereinafter.

Figure 24:
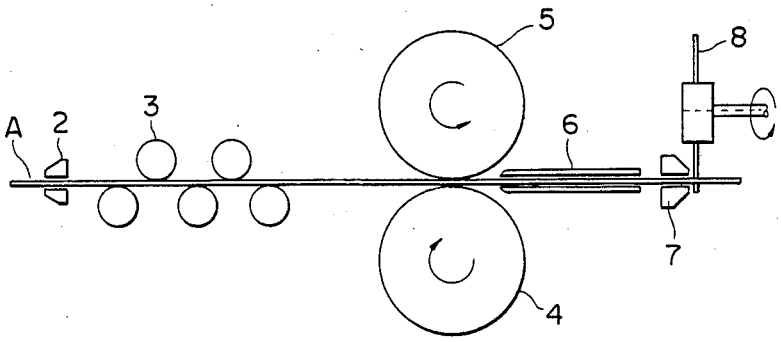
FIG. 24 is a schematic illustration of a general section-shaped steel fiber processing apparatus employing conventional forming rollers.

Prior to the description of the present invention, the general section-shaped steel fiber manufacturing process will be described with reference to FIG. 24. A section-shaped steel fiber processing apparatus has a guide die 2, tension rollers 3, a pair of forming rollers 4 and 5 for section-shaping steel wires, a cutter guide 6, a cutter die 7 and a rotary cutter 8 for cutting the section-shaped steel wires into section-shaped steel fibers.

Steel wires A are passed through the guide die 2 and the tension rollers 3, and then the steel wires A are section-shaped with the forming rollers 4 and 5. Then, the section-shaped steel wires are cut in a predetermined length at the exit of the cutter die 7 with the rotary cutter 8 to produce section-shaped steel fibers having alternate arrangement of basic portions and section-shaped portions as those described with reference to the foregoing embodiments.

Figure 25:
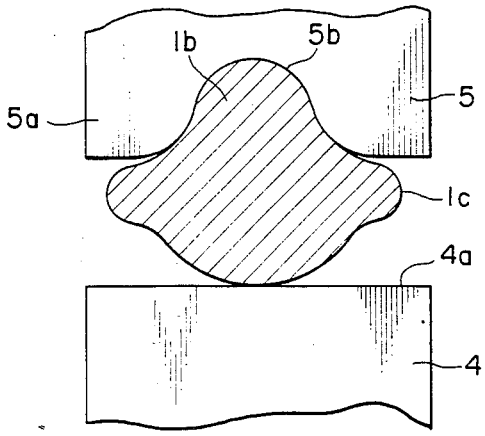
FIG. 25 is a schematic illustraton of assistance in explaining the mode of section-shaping function of the conventional forming rollers.
Figure 26A:
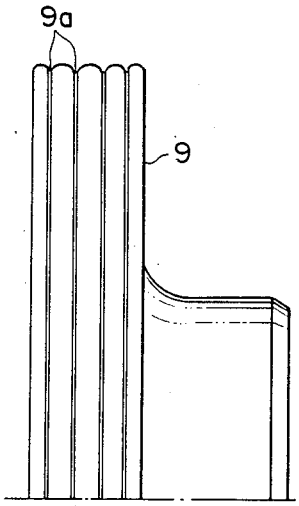
FIGS. 26*a* and 26*b* are half side elevations of a groove forming roller and a toothed forming roller, respectively, employed in a method of manufacturing steel fiber, according to the present invention.
Figure 26B:
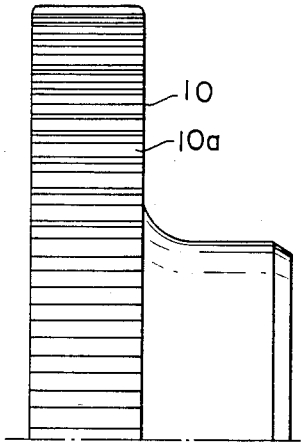
Figure 27A:
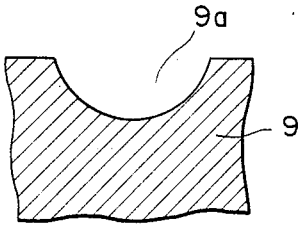
FIGS. 27*a* and 27*b* are fragmentary sectional views of the grooved forming roller and the toothed forming roller of FIGS. 26*a* and 26*b*, respectively.
Figure 27B:
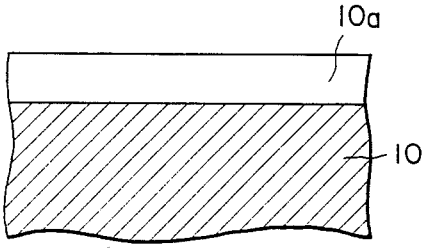
Figure 28:
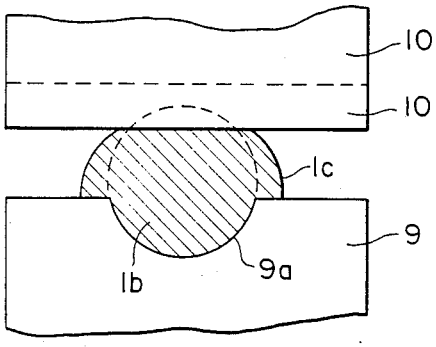
FIG. 28 is a schematic illustration of assistance in explaining the mode of section-shaping function of the forming rollers according to the present invention.

As illustrated in FIG. 25, the conventional forming roller 4 has a flat circumference, while the conventional forming roller 5 has a toothed circumference. That is, a plurality of section-shaping teeth 5*a* are formed in the circumference of the forming roller 5, and each section-shaping tooth has a recess 5*b* of a shape corresponding to a desired section-shape.

In processing steel wires for section-shaping with those conventional forming rollers 4 and 5, since the circumference of the forming roller 4 is flat and is unable to restrain the steel wires, the steel wires are liable to run off the recesses 5*b* of the forming roller 5 when the steel wires have bends therein to interrupt the section-shaped steel fiber processing operation, which causes the reduction of productivity, the reduction of yield and the deterioration of quality.

According to the present invention, a pair of forming rollers 9 and 10 are employed in the section-shaped steel fiber processing apparatus, instead of the conventional forming rollers 4 and 5. The forming roller 9 corresponding to the forming roller 4 is provided with annular grooves 9*a* in the circumference thereof. The annular grooves 9*a* have a cross section corresponding to approximately the half of the cross section of the steel wire A, so that the half of the cross section of the steel wire A is received in the annular groove 9*a*. On the other hand, the other forming roller 10 corresponding to the conventional forming roller 5 is provided with section-shaping teeth 10*a*. The section-shaping teeth 10*a* have a height corresponding to approximately the half of the height of the cross section of the steel wire A. Thus, in operation, the steel wires A are always received in the annular grooves 9*a* during the section-shaping operation, so that the steel wires A are procesed regularly without causing any trouble, even if the steel wires A have bends therein. Furthermore, when the steel wires A engage the annular groove 9*a* of the forming roller 9, bends thereof are corrected by the annular grooves 9*a*. Thus, the section-shaping operation can be continuously and smoothly carried out without interruption, so that the steel wires are section-shaped accurately, and there is no possibility of the reduction of yield and the deterioration of quality.

Although the invention has been described in its preferred embodiments with a certain degree of particularity, it is to be understood that many changes and variations are possible in the invention without departing from the scope and spirit thereof.

What is claimed is:

1. A concrete reinforcing steel fiber having excellent tensile strength, T, and adhesion to concrete, which comprises alternately arranged basic portions, each basic portion providing a pressure bearing area and each section-shaped portion providing three pressure bearing projection areas, each of said portions satisfying the inequality:

$$0.2A \leqq b \leqq 0.5A$$

wherein b is the cross-sectional area of the three pressure bearing projection areas of each section-shaped portions; and A is the cross-sectional area of a basic portion in $mm^2$, and further wherein said steel fiber has an aspect ratio in the range of 60–100, and has a total cross-sectional area, B, defined by the relationship:

$$B=b\times L/P$$

wherein L is the steel fiber length and P is the pitch of the section-shaped portions.

2. The concrete reinforcing steel fiber as recited in claim 1, wherein the total cross-sectional area B of all the projections satisfies an inequality: $3A \leqq B \leqq 8A$.

3. The concrete reinforcing steel fiber as recited in claim 2, wherein the relation between the total cross-sectional area B of all the projections and the tensile strength T (kg) thereof is expressed by: $0.02T \leqq B \leqq 0.08T$.

4. A concrete reinforcing steel fiber having excellent tensile strength and adhesion to concrete, which comprises alternately arranged basic portions and section-shaped portions, each basic portion providing a pressure bearing area and each section-shaped portion providing three pressure bearing projection areas, and wherein said basic portions and said section-shaped portions have a projection area ratio in the range of 20–50%, said ratio being the ratio of a cross-sectional area of the projections of a section-shaped portion to a cross-sectional area of a basic portion.

5. A concrete reinforcing steel fiber having excellent tensile strength and adhesion to concrete, which comprises alternatively arranged basic portions and section-shaped portions, each basic portion providing a pressure bearing area and each section-shaped portion providing two pressure bearing areas; and wherein said steel fiber has a straight axis, and a pressure bearing area coefficient in the range of 0.0042 to 0.025, said pressure bearing area coefficient being the ratio of a pressure bearing area of a section-shaped portion to the product of the pitch length and the circumferential length of a basic portion.

6. The concrete reinforcing steel fiber as recited in claim 5, wherein the tensile strength thereof is in the range of 100 to 140 $kg/mm^2$.

7. The concrete reinforcing steel fiber as recited in claim 5, wherein the steel fiber has a diameter in the range of 0.3 to 1.0 mm and a length in the range of 15 to 80 mm.

* * * * *